US008418390B1

(12) United States Patent
Wright

(10) Patent No.: US 8,418,390 B1
(45) Date of Patent: Apr. 16, 2013

(54) MAGAZINE FEED ATTACHMENT FOR SHOTGUN

(76) Inventor: Robert Wright, Lyons, OR (US)

( * ) Notice: Subject to any disclaimer, the term of this patent is extended or adjusted under 35 U.S.C. 154(b) by 140 days.

(21) Appl. No.: 12/984,797

(22) Filed: Jan. 5, 2011

Related U.S. Application Data

(60) Provisional application No. 61/292,372, filed on Jan. 5, 2010.

(51) Int. Cl.
*F41A 9/61* (2006.01)

(52) U.S. Cl.
USPC ..... 42/49.01; 49/50

(58) Field of Classification Search ..... 42/49.01, 42/50, 87, 88
See application file for complete search history.

(56) References Cited

U.S. PATENT DOCUMENTS

| | | | | | |
|---|---|---|---|---|---|
| 2,062,079 | A | * | 11/1936 | Wiles | 42/71.01 |
| 2,355,045 | A | * | 8/1944 | Audet | 42/50 |
| 2,601,735 | A | * | 7/1952 | Brush | 42/17 |
| 2,642,688 | A | * | 6/1953 | Johnson, Jr. | 42/50 |
| 2,765,558 | A | | 10/1956 | Roper et al. | |
| 2,803,908 | A | * | 8/1957 | Raley | 42/22 |
| 2,827,728 | A | | 3/1958 | Simmons | |
| 2,875,544 | A | * | 3/1959 | Krieger | 42/18 |
| 4,528,765 | A | * | 7/1985 | Johnson | 42/70.11 |
| 4,864,758 | A | * | 9/1989 | Crossman | 42/18 |
| 5,027,541 | A | * | 7/1991 | Velezis | 42/18 |
| 5,054,221 | A | | 10/1991 | Ozols | |
| 5,456,153 | A | * | 10/1995 | Bentley et al. | 89/33.02 |
| 5,561,258 | A | * | 10/1996 | Bentley et al. | 89/33.17 |
| 5,600,083 | A | * | 2/1997 | Bentley et al. | 89/33.02 |
| 6,912,806 | B2 | * | 7/2005 | Malindretos | 42/17 |
| 7,810,271 | B2 | * | 10/2010 | Patel | 42/75.03 |

* cited by examiner

*Primary Examiner* — Samir Abdosh
(74) *Attorney, Agent, or Firm* — Dwayne E. Rogge; Schacht Law Office, Inc.

(57) ABSTRACT

Disclosed herein is a retrofit device to be attached to shotguns and other long barrel firearms, such as some rifles, to allow adaptation of the firearm for attachment to a detachable box magazine.

5 Claims, 5 Drawing Sheets

MAGAZINE FEED ATTACHMENT FOR SHOTGUN

RELATED APPLICATIONS

This application claims priority benefit of U.S. Ser. No. 61/292,372, filed Jan. 5, 2010.

BACKGROUND OF THE DISCLOSURE

Field of the Disclosure

This disclosure relates generally to a retrofit device to be attached to shotguns and other long barrel firearms, such as some rifles, to allow adaptation of the firearm for attachment to a detachable box magazine. Many prior art firearms, such as that disclosed in U.S. Pat. No. 2,081,235, were specifically formed to allow insertion of a removable box magazine by way of engaging the forward portion of the box magazine generally, as indicated at 42, and then pivoting the box magazine around this point until a rearward engagement latch, such as that shown at 48, would maintain engagement of the box magazine within the firearm. Additionally, some firearms were formed with non-removable magazines, wherein the magazine would be attached to the firearm, and once attached, shells would be fed into the magazine normally through the firearm breech or a similar portion of the firearm. One such non-removable magazine is the tube magazine found in many pump-action shotguns. Another example is the fixed box magazines often found in bolt action firearms. Enclosed herein is the disclosure to retrofit these and other styles of firearms with non-removable magazines or no magazines, which allows for linear insertion of a modern-style straight insert box magazine. Such straight insert magazines are well known in current automatic weapons and some semi-automatic weapons, including AAR-15's, M-16's and others.

SUMMARY OF THE DISCLOSURE

Disclosed herein are several embodiments of a retrofit magazine well for a shotgun having a receiver location. The retrofit magazine well comprises a magazine well body and a release lever. The magazine well body comprises an exterior surface, an interior surface configured to removably receive a shotgun shell box magazine, an upper surface configured to engage the receiver location of the shotgun, and a plurality of surfaces defining voids configured to receive fasteners therethough, which engage aligned threaded surfaces within the shotgun adjacent the receiver location of the shotgun. The release lever comprises a user engagement end, a pivotable coupling to the magazine well body, and a magazine engagement end, operatively configured to release or retain the box magazine within the interior surface of the magazine well body.

The retrofit magazine well body is comprised of two separate sub portions, which are substantially mirror images of each other. The retrofit magazine may be arranged wherein the user engagement end of the release lever extends rearward beyond the well body.

Also disclosed is a method for retrofitting a firearm comprising the steps of providing a magazine well body and a release lever as described, gaining access to the chamber of the firearm, and fixing the magazine well body to the firearm such that the interior surface of the magazine well body is contiguous with the chamber of the firearm.

DESCRIPTION OF THE PREFERRED EMBODIMENTS

Figure 1:
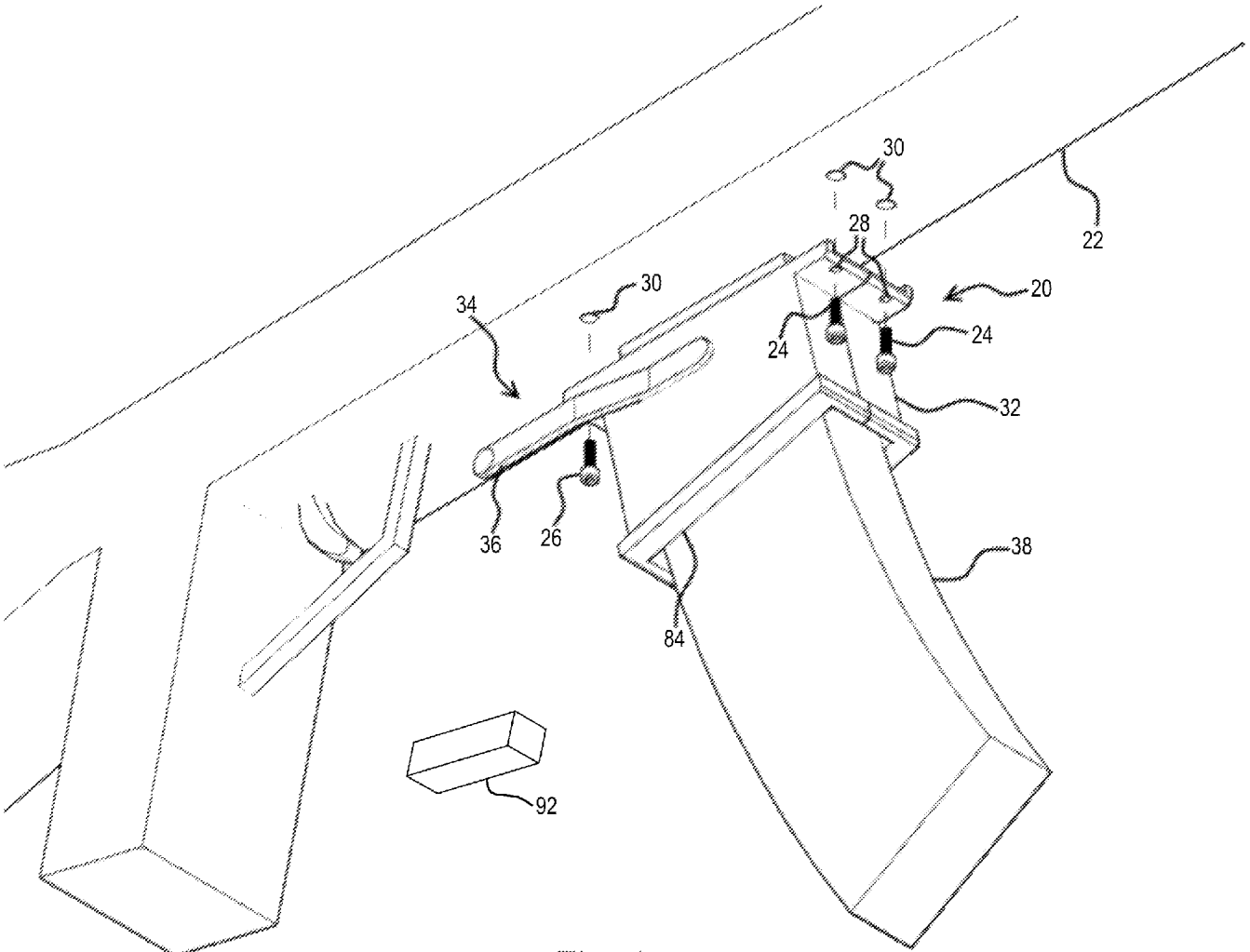
FIG. 1 is an isometric view of the retrofit adapter being mounted upon a highly schematic firearm.

Looking to FIG. 1, the adapter 20 is shown being attached to a highly schematic firearm 22 by way of a plurality of forward fasteners 24 and a plurality of rear fasteners 26, of which only one can be seen in this view. In one form, the fasteners 24 and 26 are attached through a plurality of clearance holes 28, and they engage a plurality of threaded holes 30 in the firearm 22. The adapter 20 generally comprises two separate portions, one being the magazine receiver 32 and the other being a latch 34, generally comprising a release lever 36 and other components to be disclosed below. The magazine receiver 32 is configured to accept a straight insert, detachable box magazine 38, which is held in place by way of the latch 34, as will be discussed later.

Figure 2:
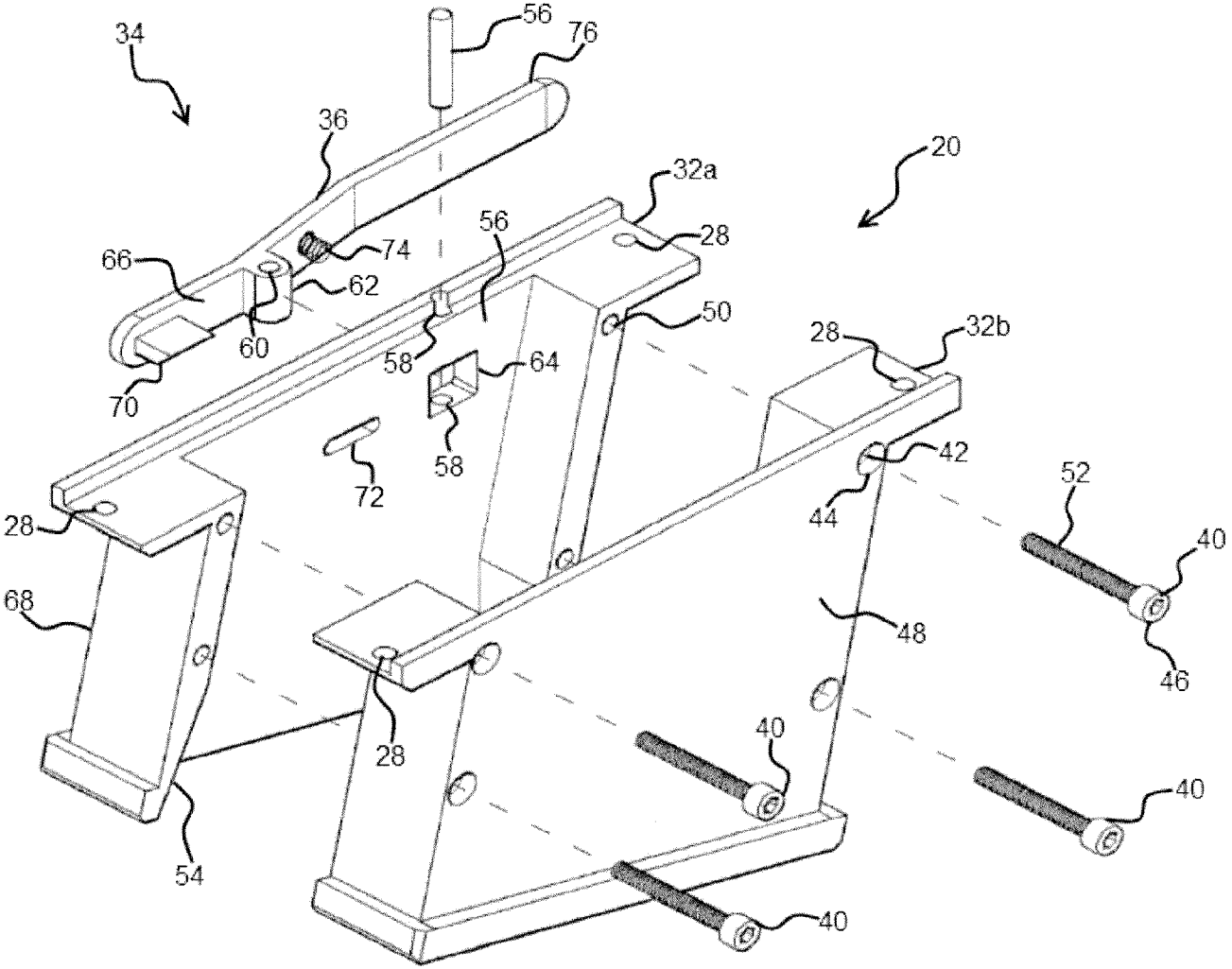
FIG. 2 is an isometric exploded view of the components of the adapter.

Looking to FIG. 2, an exploded view of the adapter 20 can be seen, wherein the magazine receiver 32 comprises a right side portion 32*a* and a left side portion 32*b*, which are substantially mirror images of each other and may be attached by way of fasteners 40 or other means. It may be desired to have a clearance hole 42 within the left side portion 32*b* and possibly a recess 44 to allow the head 46 of the fastener 40 to reside therein, such that the head 46 of the fastener 40 does not extend outward beyond the left outer surface 48. Furthermore, a threaded hole 50 may be provided in the right side portion 32*a* to receive the threaded portion 52 of the fasteners 40. Additionally, each of these portions may comprise a tapered cutout, engagement or receiving surface 54, which is configured to allow easy placement of the box magazine 38 within the interior portion 56 of the adapter 20. These receiving surfaces 54 will be described in more detail with regards to FIG. 6.

The latch 34, in one form, can also be quite readily understood by looking at FIG. 2. The latch 34 in this embodiment comprises the release lever 36, which is pivotably attached to the magazine receiver 32 by way of a pivot pin 56, which is fitted through a matching void 58 in the adapter 20 and a matching a void 60 in an extension 62 of the release lever 36. The extension 62 generally fits within a void 64 provided in the receiver 32, wherein the void 64 is sized and configured to allow rotation of the release lever 36 about the pivot pin 56. As shown, the release lever 36 comprises a forward surface 66, which is normally parallel to and in contact with the right outer surface 68 of the adapter 20, such that a tapered extension 70 extends through a void 72 to the interior portion of the adaptor 20. The tapered extension 70 is operatively configured to engage a void in a modern, straight insert, box magazine, such as is well known in the art. A spring 74 or similar apparatus may be configured to provide elastic force to maintain the release lever 36 in this position until a user exerts force upon the rearward extension 76 toward the right outer surface 68, which will pivot the release lever 36 about the pivot pin 56, thus removing the tapered extension 70 from the interior portion of the adapter 20, and thus releasing the box magazine 38 by way of gravity, or in some cases by elastic means. One example of a magazine utilizing this type of attachment is described in U.S. Pat. No. 4,139,959, incorporated herein by reference, which includes an opening generally at 18 of FIG. 1 for connection to the tapered extension 70, as described above. This is but one example of such a cartridge, and other arrangements are well known in the art.

While the latch is shown as extending from and being activated from the right side of the firearm, the latch could just as easily extend from the left side, or alternately could be configured to extend from both sides, with special provisions made for this arrangement.

Figure 3:
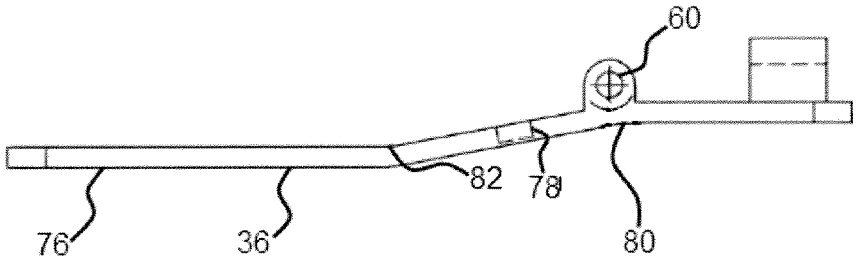
FIG. 3 is a plan view of the release latch, in one form.
Figure 4:
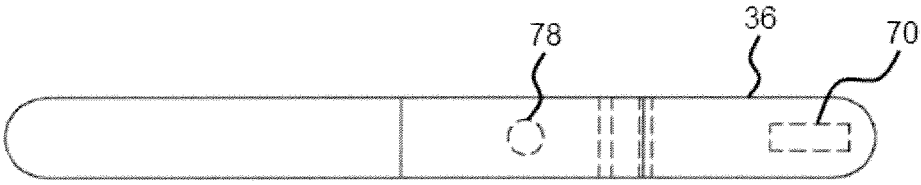
FIG. 4 is a side hidden line view of the release latch, in one form.

Looking to FIG. 3, the release lever 36 is shown in plan view, including a recess 78 for the spring 74, as well as the void 60 for passage of the pivot pin 56. It can also be seen how in one form the release lever 36 is bent at points 80 and 82 to allow the user to easily engage the rearward extension 76 and to allow the release lever 36 to pivot about the void 60. These elements are also shown in the side view of FIG. 4.

Figure 5:
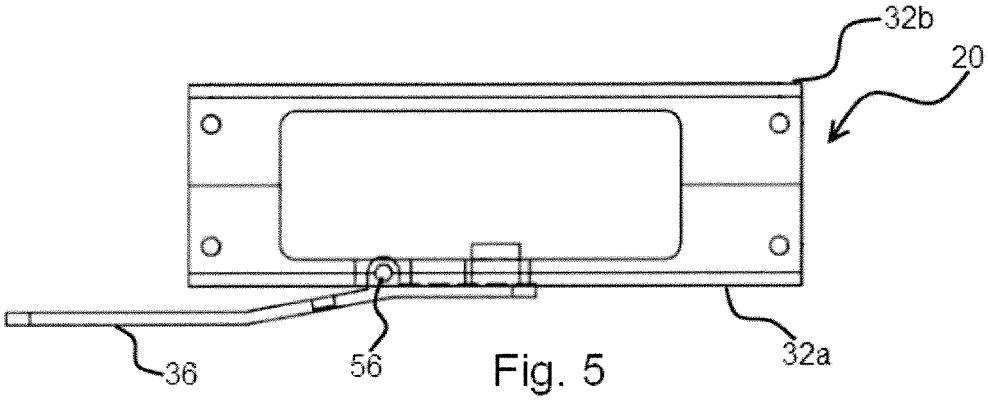
FIG. 5 is a plan view of an assembled adapter.
Figure 6:
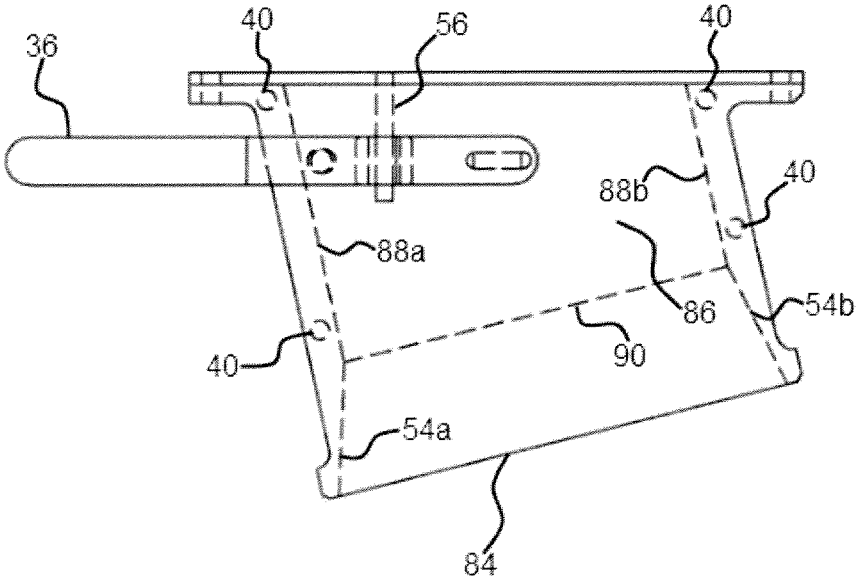
FIG. 6 is a side hidden line view of the adapter, in one form.
Figure 7:
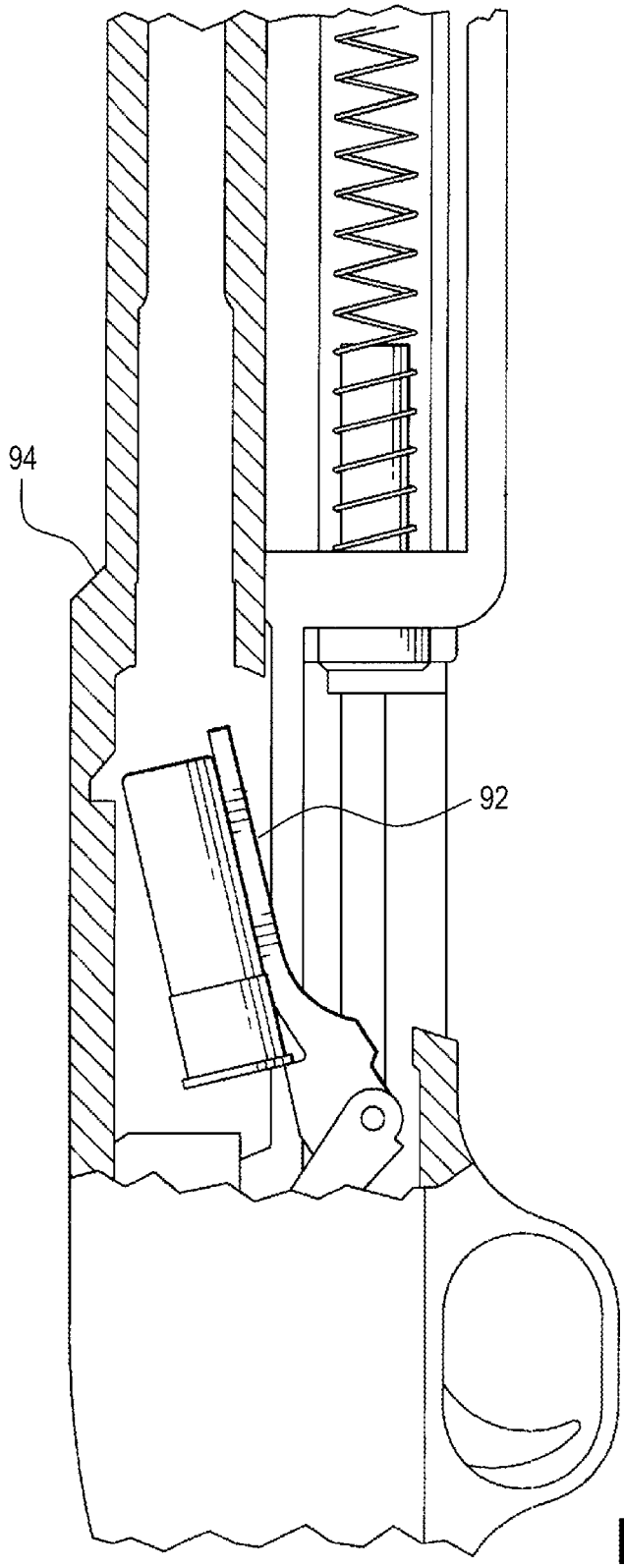
Fig. 7 Prior Art
FIG. 7 is a side partial cutaway view of a prior art shotgun.

The release lever 36 and adapter 20 are also shown in an assembled plan view in FIG. 5. Additionally, FIG. 6 shows a side cutaway view of these components. Additionally, in FIG. 6, it can be seen how the receiving surfaces 54*a* and 54*b* allow for easy positioning of the box magazine into the opening 84 of the adapter 20, as the adapter opening 84 is substantially larger than at the upper portion 86 where the guide surfaces 88*a* and 88*b* are substantially parallel and only slightly larger than the magazine 38, such that once the magazine passes the border 90 between the tapered portion 54 and the parallel portion 88, the magazine 38 will be in the correct alignment relative to the chamber of the firearm 22.

In one form, to mount the adapter 20 to a firearm 22, such as a shotgun, the "elevator" 92 of a tube-fed shotgun 94 would be removed and the adapter 20 would be attached thereto so as to allow the firearm to utilize a straight-insert, detachable box magazine 38.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A retrofit magazine well for a shotgun having a receiver location, the retrofit magazine well comprising:

a. a magazine well body comprising
  i. an exterior surface,
  ii. an interior surface configured to removably receive a shotgun shell box magazine;
  iii. an upper surface configured to engage a lowermost surface of the receiver location of the shotgun;
  iv. the upper surface comprising a plurality of surfaces defining voids configured to receive fasteners therethrough which engage aligned threaded surfaces within the shotgun adjacent the receiver location of the shotgun;

b. a pivoting release lever comprising
  i. a user engagement end;
  ii. a pivot pin connecting the release lever to the magazine well body; and
  iii. a magazine engagement end wherein the pivot pin is positioned between the user engagement end and the magazine engagement end, the magazine engagement end operatively configured to release or retain the box magazine within the interior surface of the magazine well body.

2. The retrofit magazine well as recited in claim 1 wherein the magazine well body is comprised of two separate sub portions which are substantially mirror images of each other.

3. The retrofit magazine well as recited in claim 1 wherein the user engagement end of the release lever extends rearward beyond the well body.

4. A method for retrofitting a firearm comprising the steps of:

a. providing a magazine well body comprising
  i. an exterior surface,
  ii. an interior surface configured to removably receive a shotgun shell box magazine;
  iii. an upper surface configured to be attached to a lower edge of the receiver location of the shotgun;
  iv. a plurality of surfaces defining voids configured to receive fasteners therethrough which engage aligned threaded surfaces within the shotgun adjacent the receiver location of the shotgun;

b. providing a release lever comprising
  i. a user engagement end;
  ii. a pivot pin connecting the release lever to the magazine well body; and
  iii. a magazine engagement end wherein the pivot pin is positioned between the user engagement end and the magazine engagement end, the magazine engagement end operatively configured to release or retain the box magazine within the interior surface of the magazine well body;

c. gaining access to a chamber of the firearm; and d. fixing the magazine well body to the firearm such that the interior surface of the magazine well body is contiguous with the chamber of the firearm.

5. The method for retrofitting a firearm as recited in claim 4 further comprising the step of removing an elevator from the firearm prior to attaching the magazine well body.

* * * * *